US012024335B2

(12) United States Patent
Zheng et al.

(10) Patent No.: US 12,024,335 B2
(45) Date of Patent: Jul. 2, 2024

(54) CONTAINER ASSEMBLY AND CONTAINER

(71) Applicant: SUZHOU DAKE INVESTMENT CONSULATION CO., LTD., Suzhou (CN)

(72) Inventors: Huamin Zheng, Suzhou (CN); Wenjie Li, Suzhou (CN)

(73) Assignee: SUZHOU DAKE INVESTMENT CONSULATION CO., LTD., Suzhou (CN)

( * ) Notice: Subject to any disclaimer, the term of this patent is extended or adjusted under 35 U.S.C. 154(b) by 196 days.

(21) Appl. No.: 17/680,756

(22) Filed: Feb. 25, 2022

(65) Prior Publication Data

US 2023/0027343 A1 Jan. 26, 2023

(30) Foreign Application Priority Data

Jul. 21, 2021 (CN) ..... 202110823130.5
Sep. 1, 2021 (CN) ..... 202122090469.7

(51) Int. Cl.
*B65D 21/02* (2006.01)
*B65D 25/28* (2006.01)
(Continued)

(52) U.S. Cl.
CPC ..... *B65D 21/0228* (2013.01); *B65D 25/2841* (2013.01); *B65D 43/163* (2013.01); *B65D 43/22* (2013.01)

(58) Field of Classification Search
CPC ..... B65D 21/0228; B65D 21/023; B65D 25/2841; B65D 43/163; B65D 43/22; B25H 3/02
(Continued)

(56) References Cited

U.S. PATENT DOCUMENTS 7,537,119 B2 * 5/2009 Becklin ..... B65D 21/0222 206/508
8,459,495 B2 * 6/2013 Koenig ..... B65D 25/2858 220/761
(Continued)

FOREIGN PATENT DOCUMENTS

AU 2021100366 A4 4/2021
CN 202439909 U 9/2012
(Continued)

*Primary Examiner* — John K Fristoe, Jr.
*Assistant Examiner* — Madison L Poos
(74) *Attorney, Agent, or Firm* — Flaster Greenberg P.C.

(57) ABSTRACT

The application relates to a container assembly and a container. The container assembly comprises a first and a second container that are assembled to each other in a detachable manner. The first container has a first surface and the second container has a second surface. When the first container is assembled with the second container, the first surface is associated with the second surface. The first container comprises a first container body and a connection element mounted to the first container body. The connection element has an arm suspended on the first surface. The second container comprises a latch element arranged on the second surface, wherein the latch element is configured to be associated with the arm for assembling the first and the second container. Two or more such containers can be assembled to each other by means of association of the connection element of one container with the latch element of another container, so that the storage or transportation of the containers or the container assembly can be simplified.

18 Claims, 8 Drawing Sheets

(51) Int. Cl.
*B65D 43/16* (2006.01)
*B65D 43/22* (2006.01)

(58) Field of Classification Search
USPC ..... 206/509
See application file for complete search history.

(56) References Cited

U.S. PATENT DOCUMENTS

| | | | | |
|---|---|---|---|---|
| 10,434,638 | B1 * | 10/2019 | Tsai | B65D 21/0223 |
| 10,583,962 | B2 | 3/2020 | Brunner et al. | |
| 10,703,534 | B2 | 7/2020 | Brunner et al. | |
| 10,981,696 | B2 | 4/2021 | Brunner et al. | |
| 2004/0195793 | A1 | 10/2004 | Sullivan et al. | |
| 2011/0139665 | A1 | 6/2011 | Madsen | |
| 2018/0161975 | A1 * | 6/2018 | Brunner | B25H 3/028 |
| 2019/0001482 | A1 * | 1/2019 | Wolle | B25H 3/02 |
| 2019/0225371 | A1 | 7/2019 | Hoppe et al. | |
| 2020/0147781 | A1 * | 5/2020 | Squiers | A45F 3/047 |
| 2020/0299027 | A1 | 9/2020 | Brunner et al. | |
| 2021/0016928 | A1 | 1/2021 | Brunner et al. | |
| 2021/0031975 | A1 * | 2/2021 | Brunner | B65D 21/0228 |
| 2023/0136626 | A1 * | 5/2023 | Cai | B25H 3/02 206/503 |
| 2023/0150725 | A1 * | 5/2023 | Baron | B65D 21/023 206/509 |

FOREIGN PATENT DOCUMENTS

| | | | |
|---|---|---|---|
| CN | 110254902 | A | 9/2019 |
| DE | 102015013053 | A1 | 4/2017 |
| WO | 2020202146 | A1 | 10/2020 |
| WO | 2021000525 | A1 | 1/2021 |

* cited by examiner

CONTAINER ASSEMBLY AND CONTAINER

CROSS-REFERENCE TO RELATED APPLICATIONS

This application claims the priority benefit of Chinese Patent Application No. 202110823130.5, filed Jul. 21, 2021, the contents which is incorporated by reference in its entirety. This application also claims the benefit of Chinese Patent Application number 202122090469.7, filed Sep. 1, 2021, the contents which is incorporated by reference in its entirety.

TECHNICAL FIELD

The application relates to the technical field of storage of articles, in particular to a container assembly and a container.

BACKGROUND OF INVENTION

A container assembly is a storage means as an assembly of multiple containers. A typical container may be a suitcase, a toolbox, a storage box, a cable storage case or the like. For example, a combined toolbox may be used to store various hand tools, electrical tools and the like articles. The combined toolbox can not only conveniently store articles, but also can be easily managed and carried, and thus is an important way for a tool user to store and transport tools. Toolbox modules of a known combined toolbox are mainly combined by a locking mechanism of a container body. If the weight of a single module is large, the locking mechanism can be easily damaged. In addition, the locking mechanism is integrally formed with the container body of the toolbox module, and thus a mold is complicated, which is relevant to high design cost of the mold.

SUMMARY OF INVENTION

An object of the application is to provide a container assembly and a container, wherein one container can be reliably combined with another container.

An aspect of the application provides a container comprising a container body with a first and a second surface opposite to each other, wherein, the container further comprises a connection element mounted to the container body and a latch element connected to the container body, wherein the connection element has an arm suspended on the first surface and the latch element is arranged on the second surface;

wherein the container is configured such that, when two such containers are assembled to each other, the first surface of one container can be associated with the second surface of the other container, wherein the latch element of the other container can be associated with the arm of the one container.

In some embodiments, the connection element of the container may comprise a first and a second arm suspended on the first surface, and a first and a second latch element may be arranged on the second surface, wherein the first and the second arm and the first and the second latch element may be configured such that, when two such containers are assembled to each other, the first latch element of the other container can be associated with the first arm of the one container and the second latch element of the other container can be associated with the second arm of the other container.

In some embodiments, the connection element may further comprise a bridge connecting the first and the second arm.

In some embodiments, the connection element may have a first position, in which an orthographic projection of the bridge on the first surface is located within the container body, and a second position, in which an orthographic projection of the bridge on the first surface at least partially protrudes from the container body, so that the bridge can be gripped by a user.

In some embodiments, the connection element may be rotatably mounted to the container body.

In some embodiments, the container may be configured such that, when two such containers are assembled to each other, the other container can be assembled to the one container in a first direction.

In some embodiments, the container may have a plurality of spaces disposed on the first surface and aligned in the first direction, wherein the number of the connection elements is plural and the plurality of connection elements are aligned in the first direction, wherein the number of latch elements on the second surface of the container is plural and the plurality of latch elements are aligned in the first direction, wherein the plurality of connection elements and the plurality of latch elements are configured such that, when two such containers are assembled to each other, the plurality of latch elements of the other container are associated with the respective connection elements of the one container.

In some embodiments, the container body may comprise a plurality of spaces aligned in a second direction perpendicular to the first direction and ribs between respective two adjacent spaces, wherein the connection elements are partially received in the ribs and are supported by the ribs, wherein the arms are located in the spaces.

In some embodiments, the container body may comprise a protrusion that is located in the respective space and supports the arm of the respective connection element.

In some embodiments, the protrusion may be provided with a groove running therethrough in the second direction, wherein the respective connection element is partially received in the groove.

In some embodiments, each space may comprise a bottom surface and a first, a second, a third and a fourth side surface that are connected to the bottom surface. Optionally, the first, the second, the third and the fourth side surface respectively have an obtuse angle to the bottom surface. Optionally, the first and the second side surface extend parallel to the first direction, and the third and the fourth side surface extend parallel to an extension direction of the connection element.

In some embodiments, the third and the fourth side surface may be aligned in the first direction, wherein a distance from the arm to the third side surface is greater than a distance from the arm to the fourth side surface, wherein the third side surface is upstream of the fourth side surface in an assembling direction of the container.

In some embodiments, the container may comprise a locking unit and a locking groove (for example it runs through the first surface), which are configured such that, when two such containers are assembled to each other, the locking unit of the other container is associated with the locking groove of the one container.

In some embodiments, the locking unit and the locking groove may be configured such that, when two such containers are assembled to each other, the locking unit of the other container is associated with the locking groove of the one container for the positioning of two such containers in a first direction and in a second direction perpendicular to the first direction, and wherein the arm of the connection element of the one container is associated with the latch element of the other container for the positioning of two such containers in a third direction perpendicular to the first and the second direction.

In some embodiments, the container may comprise a guide groove leading to the locking groove, wherein the guide groove is configured such that, when two such containers are assembled to each other, the locking unit of the other container is guided by the guide groove of the one container before entering the locking groove of the one container.

In some embodiments, the guide groove may be tapered toward the locking groove, for example, the guide groove may be configured as a trapezoidal groove.

In some embodiments, the locking groove may be configured as a rectangular groove.

In some embodiments, at a transition between the guide groove and the locking groove, a width of the locking groove increases abruptly with respect to a width of the guide groove. Therefore, when the locking unit enters the locking groove through the guide groove, the locking unit can quickly expand for the positioning of the two assembled containers in two directions.

In some embodiments, the container body may have a first and a second space aligned in a first direction, wherein the first arm of the connection element is located in the first space and the second arm of the connection element is located in the second space.

In some embodiments, the connection element may be movable in a second direction perpendicular to the first direction when it's shifted from the first position to the second position. Optionally, a range of movement is less than half of a length of the first arm.

In some embodiments, the first surface may be a top surface of the container body and the second surface may be a bottom surface of the container body.

In some embodiments, the container may be a toolbox, a suitcase, a storage box or the like.

In some embodiments, the container body may be two-piece with an upper cover and a base.

In some embodiments, the upper cover may be connected to the base pivotally around a pivot axis.

In some embodiments, the container body may be substantially cuboid-shaped. Alternatively, the container body may be substantially circular cylindrical or substantially elliptic cylindrical.

In some embodiments, the first direction may correspond to a width direction of the container body, the second direction may correspond to a length direction of the container body, and the third direction may correspond to a height direction of the container body.

The application also provides a container assembly, which comprises a first and a second container that are assembled to each other in a detachable manner, wherein the first container has a first surface, and the second container has a second surface, wherein the first surface is associated with the second surface when the first container is assembled with the second container, wherein the first container comprises a first container body and a connection element mounted to the first container body, wherein the connection element has an arm suspended on the first surface, wherein the second container comprises a latch element arranged on the second surface, and the latch element is configured to be associated with the arm for assembling the first and the second container.

By association of the connection element of the one container with the latch element of the other container, two or more such containers can be assembled to each other, so that the storage or transportation of the containers is simplified. In some embodiments, the connection element may be separately molded, so the mold cost is low. Meanwhile, the connection element may also have a high structural strength.

In some embodiments, the first container may be assembled to the second container in a first direction.

In some embodiments, the first container may have a plurality of spaces aligned in the first direction, wherein the number of the connection elements is plural and the plurality of connection elements are aligned in the first direction, wherein the number of the latch elements of the second container is plural and the plurality of latch elements are aligned in the first direction, wherein the arms of the connection elements are respectively arranged in the plurality of spaces aligned in the first direction and are configured to be associated with the respective latch elements.

In some embodiments, the connection element may be rotatably mounted to the first container body.

In some embodiments, the first container body may comprise a plurality of spaces aligned in a second direction and ribs located between respective two adjacent spaces, wherein the connection elements are partially received in the ribs and are supported by the ribs, and the arms are located in the spaces.

In some embodiments, the first container may be assembled to the second container in a first direction perpendicular to the second direction.

In some embodiments, the first container body may comprise a protrusion located in the respective space, and the protrusion supports the arm of the respective connection element.

In some embodiments, the protrusion may be provided with a groove running therethrough in a second direction, wherein the respective connection element is partially received in the groove.

In some embodiments, a ratio of the sum of the cross-sectional areas of the spaces to the cross-sectional area of the first container body is not less than 40% and not more than 80%.

In some embodiments, in a lying state of the first container body, a ratio of the sum of the projection areas of the spaces to the projection area of the first container body is not less than 40% and/or not more than 80%, for example, in a range of 50% to 70%.

In some embodiments, the cross sections of the spaces and the cross section of the first container body may be parallel to the first direction and the second direction.

In some embodiments, the space may comprise a bottom surface and a first, a second, a third and a fourth side surface that are connected to the bottom surface. Optionally, the first, the second, the third and the fourth side surface may respectively have an obtuse angle to the bottom surface. Optionally, the first and the second side surface extend parallel to an assembling direction of the first and the second container, and the third and the fourth side surface extend parallel to an extension direction of the connection element.

In some embodiments, the third and the fourth side surface may be aligned in an assembling direction of the first and the second container, wherein a distance from the arm to the third side surface is greater than a distance from the arm to the fourth side surface.

In some embodiments, the second container may comprise a locking unit, and the first container may comprise a locking groove running through the first surface. The locking unit is configured to be associated with the locking groove for the positioning in a first and a second direction, wherein the first direction is an assembling direction of the first and the second container, and the second direction is an extension direction of the connection element.

In some embodiments, the first container may comprise a locking unit, and the second container may comprise a locking groove running through the second surface. The locking unit is configured to be associated with the locking groove for the positioning in a first and a second direction, wherein the first direction is an assembling direction of the first and the second container, and the second direction is an extension direction of the connection element.

In some embodiments, the arm of the connection element may be associated with the latch element for the positioning in a third direction, which is perpendicular to the first and the second direction.

In some embodiments, the connection element may extend in the second direction, the first container may have a plurality of spaces aligned in the second direction, wherein the number of the connection elements is plural and the plurality of connection elements are aligned in the second direction, and the arms of the connection elements are respectively arranged in the plurality of spaces aligned in the second direction, and are configured to be associated with the respective latch elements.

The application also provides a container assembly, which comprises a first and a second container that are detachably assembled to each other, wherein the first container comprises a container body and a connection element mounted to the container body, wherein ends of the connection element are supported by the container body and the connection element has an arm arranged in a suspended manner, and the second container comprises a latch element configured to be associated with the arm for assembling the first and the second container.

In some embodiments, the connection element may be made of metal, and/or the cross-sectional area of the arm may be 12 to 200 $mm^2$.

In some embodiments, the surface of the arm may be provided with an anti-rust plating layer.

In some embodiments, the connection element may comprise a first and a second arm which are arranged in a suspended manner, and the second container may comprise a first and a second latch element, wherein the first latch element is configured to be associated with the first arm and the second latch element is configured to be associated with the second arm for assembling the first and the second container.

In some embodiments, the connection element may further comprise a bridge connecting the first and the second arm, and the bridge is configured to be gripped by a user.

In some embodiments, the first container may have a first surface associated with the second container.

In some embodiments, the connection element may have a first position, in which an orthographic projection of the bridge on the first surface is located within the container body, and a second position, in which an orthographic projection of the bridge on the first surface at least partially protrudes from the container body.

In some embodiments, the container body may have a first and a second space aligned in a first direction, wherein the first arm of the connection element is located in the first space and the second arm of the connection element is located in the second space, and wherein the first container is assembled to the second container in the first direction.

In some embodiments, the connection element may be movable in a second direction perpendicular to the first direction when it's shifted from the first position to the second position, and a range of movement is less than half of a length of the first arm.

The application also provides a container, which comprises a container body, wherein the container body has a first and a second surface opposite to each other, Wherein the container further comprises a connection element mounted to the container body and a latch element connected to the container body, wherein the connection element has an arm suspended on the first surface and the latch element is arranged on the second surface;

wherein the arm of the connection element of the container is configured to be associated with the snap element of another container, and the snap element of the container is configured to be associated with the arm of a third container.

In some embodiments, the connection element may comprise a first and a second arm which are arranged in a suspended manner, wherein the first arm is configured to be associated with one latch element of the other container, and the second arm is configured to be associated with the other latch element of the other container;

wherein the connection element further comprises a bridge connecting the first and the second arm, wherein the connection element has a first position, in which an orthographic projection of the bridge on the first surface is located within the container body, and a second position, in which an orthographic projection of the bridge on the first surface at least partially protrudes from the container body, so that the bridge can be gripped by a user.

EMBODIMENTS

Figure 1:
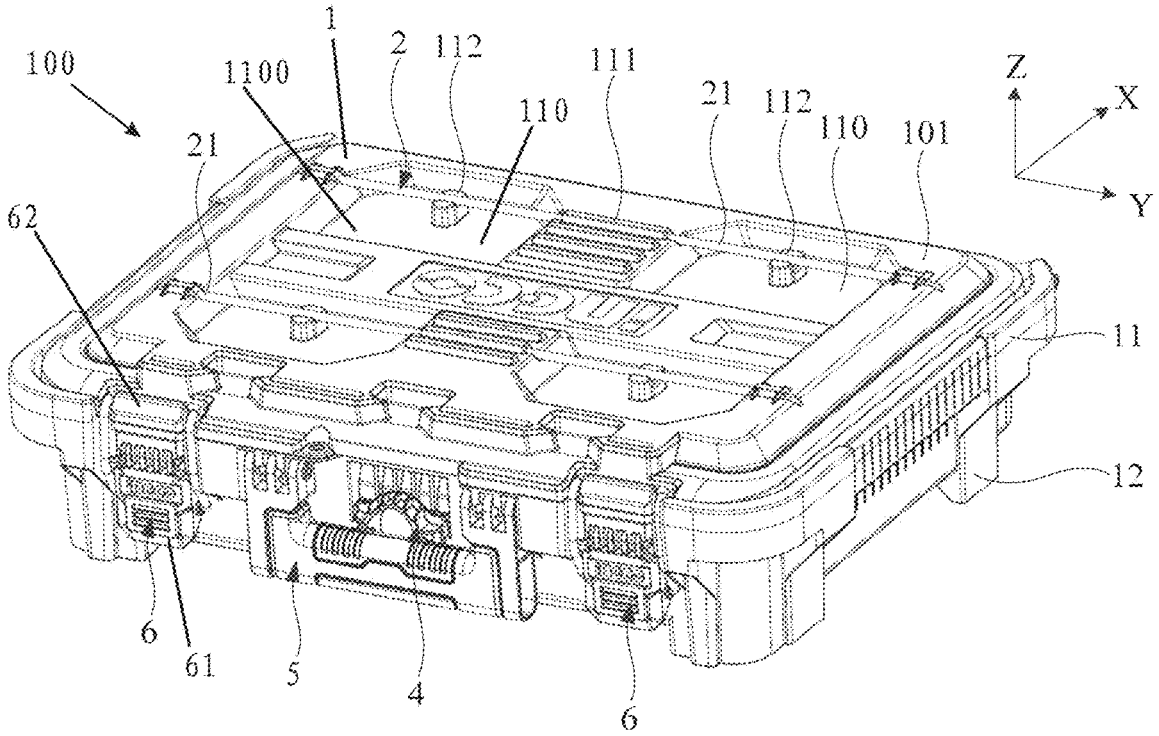
FIG. 1 is a schematic perspective view of a container in an embodiment of the present application.

Here, exemplary embodiments will be described in detail with references to the accompanying drawings. Unless otherwise indicated, the same reference numbers in different drawings refer to the same or similar elements, wherein, for convenience of expression, the reference numerals indicating the same or similar elements may be appended with letters.

An exemplary embodiment of a container and a container assembly in the present application will now be described with reference to the accompanying drawings.

First, a container 100 in an embodiment will be described with reference to FIGS. 1 to 3.

In this embodiment, the container 100 comprises a container body 1, a connection element 2 mounted to the container body 1, a latch element 3 connected to the container body, a locking unit 4 and a handle 5. The container body 1 comprises a base 12 and an upper cover 11 pivotally connected to the base 12. The upper cover 11 and the base 12 surrounds a storage room. The opening and closing of the upper cover 11 enable the storage room to be opened and closed, and the storage room is used for storing articles, such as tools, parts and the like. A connection between the upper cover 11 and the base 12 can be realized by a simple hinge 7, for example. The handle 5 is rotatably mounted to the base 12, and can rotate to a concave area of the base 12 when it isn't used.

The closing and the locking of the upper cover 11 with the base 12 can be realized by a buckle unit 6 of the container 100, which comprises a mounting part 61 and a turnover part 62 rotatably mounted to the mounting part 61, and the mounting part 61 is fixed to the base 12. When the turnover part 62 is sleeved on a latch groove of the upper cover 11, the upper cover 11 and the base 12 are locked. When the turnover part 62 is disengaged from the latch groove of the upper cover 11, the locking between the upper cover 11 and the base 12 is released. After the cover 11 and the base 12 are closed, a gap between them is sealed by a sealing ring 8, so that the storage room has a certain waterproof level.

The container body 1 has, at its outside, a first and a second surface 101, 102 opposite to each other and a space 110 recessed from the first surface, wherein the first surface 101 is an upper surface of the upper cover 11 and the second surface 102 is a lower surface of the base 12. The terms "upper" and "lower" are defined when the container body is placed horizontally. The connection element 2 has an arm 21 suspended in the space 110. The latch element 3 is arranged on the second surface 102. The arm 21 of the connection element is configured to be associated with the latch element 3 of another container. The latch element 3 of the container 100 is configured to be associated with the arm 21 of the connection element 2 of a third container. In some embodiments, it's advantageous that the arm 21 is suspended on the first surface. In some other embodiments, the first and the second surface may also be opposite sides of the container body.

Optionally, the connection element 2 is mounted to the container body 1 after the container body 1 is molded. The material of the latch element 3 needs to bear the weight of a whole container, so the strength requirement can be increased. In this embodiment, a metal material such as aluminum or steel is preferable, and a diameter of the connection element 2 may be 5 mm. In other embodiments, the diameter of the connection element may be 2-8 mm. Of course, only if the strength is sufficient (for example, the connection element 2 can bear the total mass of 50 kg), the size of the connection element may be freely selected. For improving the oxidation resistance and the corrosion resistance, a plating layer, such as a chromium plating layer, may be formed on the surface of the connection element 2. In other embodiments, the connection element 2 may be connected to the container body 1 during the molding process of the container body.

In the shown embodiment, the upper cover 11 has a plurality of spaces 110 aligned in the first direction X. The container 100 has a plurality of latch elements 3 aligned in the first direction X. The arms 21 of the connection elements 2 are arranged in the respective spaces 110 aligned in the first direction X, and are configured to be associated with the respective latch elements 3 of another container.

In an extension direction of the connection elements 2, that is to say, in a second direction Y perpendicular to the first direction X, the upper cover 11 also has a plurality of spaces 110, wherein the number of the connection elements 2 is plural and the connection elements 2 are aligned in the second direction Y. The arms 21 of the connection elements 2 are arranged in the respective spaces 110 aligned in the second direction Y and are configured to be associated with the respective latch elements 3 of the other container.

Figure 2:
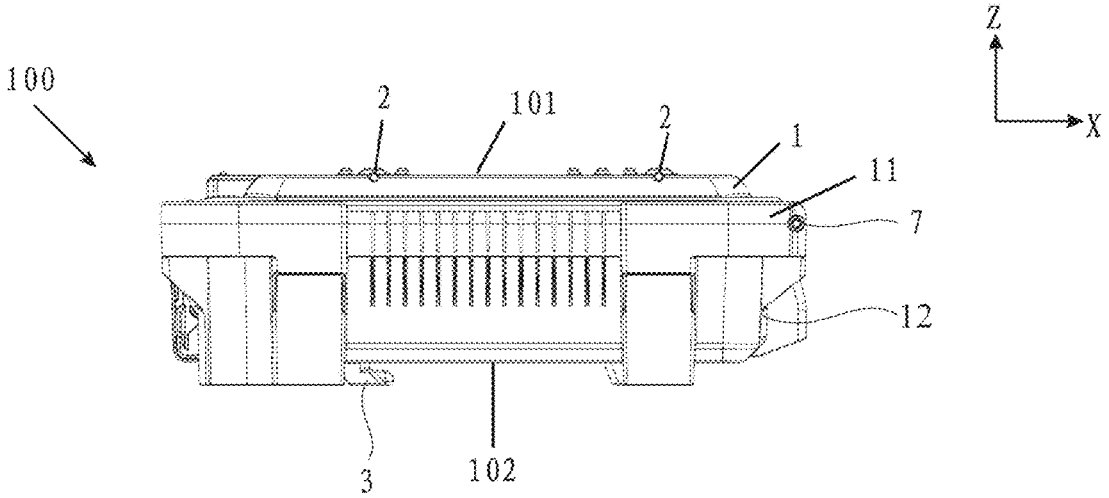
FIG. 2 is a schematic side view of the container as shown in FIG. 1.
Figure 3:
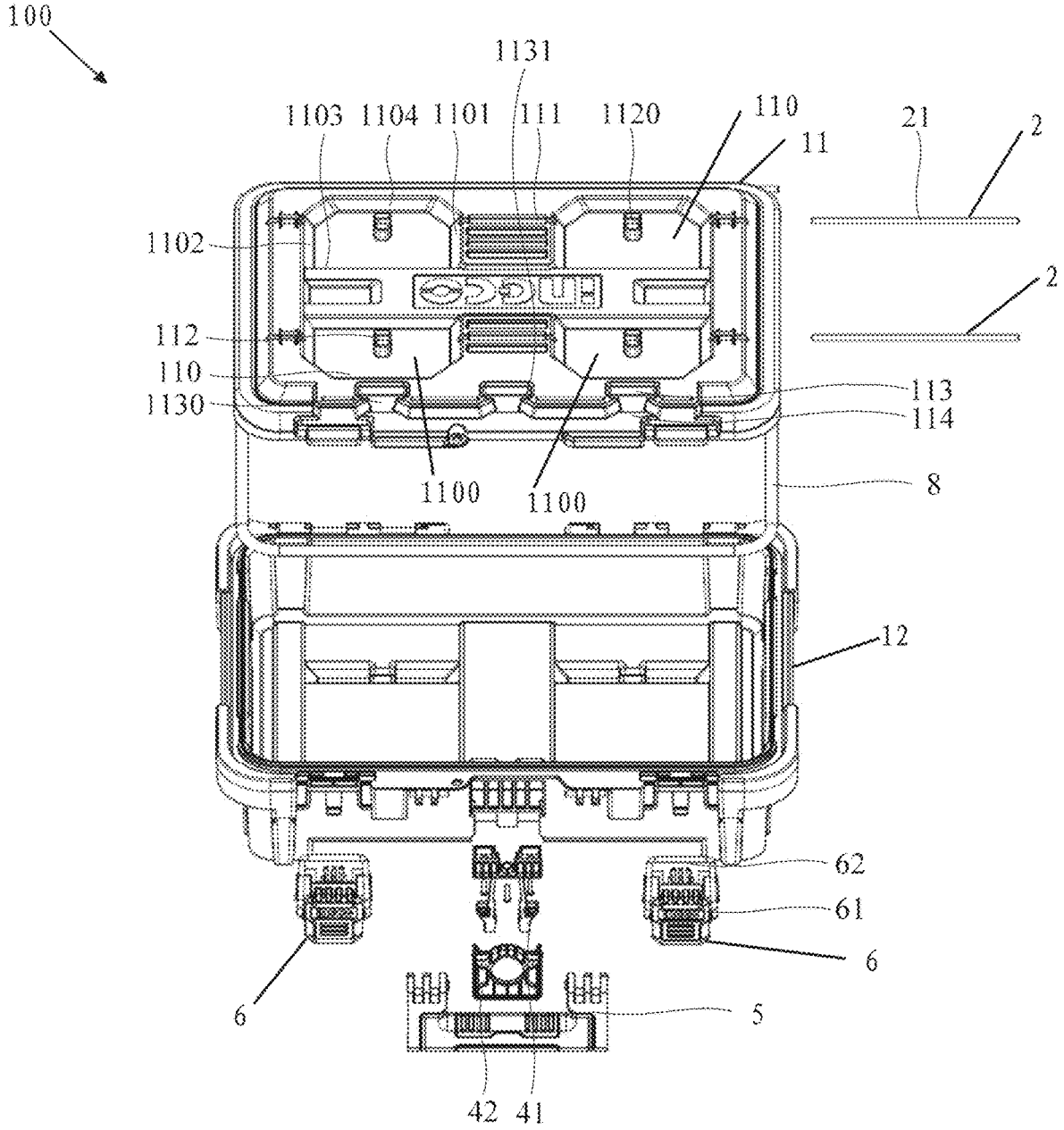
FIG. 3 is an exploded perspective view of the container as shown in FIG. 1.

More specifically, in the embodiment shown in FIGS. 1 to 3, four spaces 110 are arranged in the first surface 101 in a 2×2 matrix, wherein each space 110 is provided with its own connection element 2 or an arm 21 (only two of the connection elements are shown in FIG. 3), and correspondingly, four latch elements 3 are arranged on the second surface 102 in a 2×2 matrix.

In an embodiment (not shown), the two left spaces 110 as shown in FIGS. 1 and 3 may be replaced by one continuous space, and the two right spaces 110 may be replaced by another continuous space.

In other embodiments, one connection element may include a plurality of arms. For example, two connection elements 2 aligned in the second direction Y may be integrally connected.

The space 110 comprises a bottom surface 1100, a first side surface 1101, a second side surface 1102, a third side surface 1103 and a fourth side surface 1104, which are connected to the bottom surface. The first side surface 1101, the second side surface 1102, the third side surface 1103 and the fourth side surface 1104 may respectively have an obtuse angle to the bottom surface 1100. The first side surface 1101 and the second side surface 1102 extend parallel to an assembling direction of the two such containers (i.e. the first direction X), and the third side surface 1103 and the fourth side surface 1104 extend parallel to the extension direction of the connection element 2 (i.e. the second direction Y). The third side surface 1103 and the fourth side surface 1104 are aligned in the assembling direction of the first and the second container (i.e. the first direction X). These side surfaces are configured to play a guiding role when two such containers are assembled or disassembled. Of course, connecting surfaces may also be arranged between adjacent side surfaces, as shown in FIG. 3.

In an embodiment (not shown), each space 110 may alternatively have a substantially elliptical contour.

Optionally, a distance from the arm 21 to the third side surface 1103 is greater than a distance from the arm to the fourth side surface 1104, so as to provide a sufficient stroke for the latch element 3 in the space 110, that is to say, when one container is mounted to the other container, it may have a larger stroke, thus the assembling direction may be approximately parallel to the first surface 101.

In the shown embodiment, the cross section of the connection element 2 of the container 100 is circular, and it can be rotatably mounted to the container body 1 (or the upper cover 11), so that a sliding friction force, which is generated when the latch element 3 of the other container is associated with the connection element 2 of the container 100, can be converted into a rolling friction force, which is beneficial to reduction of an operating force applied by a user when he assemblies the two containers, and thus the user's experience may be improved. In other embodiments, the cross section of the connection element 2 may alternatively have another shape, such as triangle, quadrangle, pentagon, or any other regular or irregular shape.

In principle, the larger the number of spaces 110, the arms 21 and the latch elements 3, the denser their distribution, and the more reliable the assembly of the two containers. Of course, if the total area of the spaces 110 is too large, the strength of the upper cover 11 may be affected negatively. Preferably, the ratio of the sum of the cross-sectional areas of the spaces 110 to the cross-sectional area of the container body 1 is not less than 40% and not more than 80%, wherein the cross sections of the spaces 110 and the cross section of the container body 1 are parallel to the first direction X and the second direction Y, and perpendicular to the third direction Y.

The container body 1 (the upper cover 11) comprises ribs 111 located between the two adjacent spaces 110 in the second direction Y. The connection elements 2 are partially received in the ribs 111 and are supported by the ribs 111. Specifically, the ribs 111 are provided with through holes, into which the connection elements 2 are inserted. Preferably, sleeves with higher structural strength may be arranged in the through holes, so that the force of the connection elements 2 on the ribs 111 can be supported by the sleeves, and thus the ribs are prevented from being damaged due to excessive stress.

The container body 1 (or the upper cover 11) further comprises protrusions 112 located in the spaces 110, which support the connection elements. Especially, when the containers are stacked, the arms need to bear the weight of the upper container(s) and the contents in the upper containers and aren't deformed, wherein the protrusions 112 may have a good supporting effect. Preferably, each protrusion 112 is provided with a groove 1120 running therethrough in the second direction Y. The respective connection element 2 is partially received in the groove 1120, and lateral surfaces of the groove 1120 can limit the deformation of the protrusion 112 in the first direction X.

By association of the arms 21 of the connection elements 2 and the latch elements 3, the positioning of the two containers in a third direction Z is realized, wherein the third direction Z is perpendicular to the first direction X and the second direction Y. The positioning in the first direction X and in the second direction Y is realized by the locking unit 4.

Figure 4:
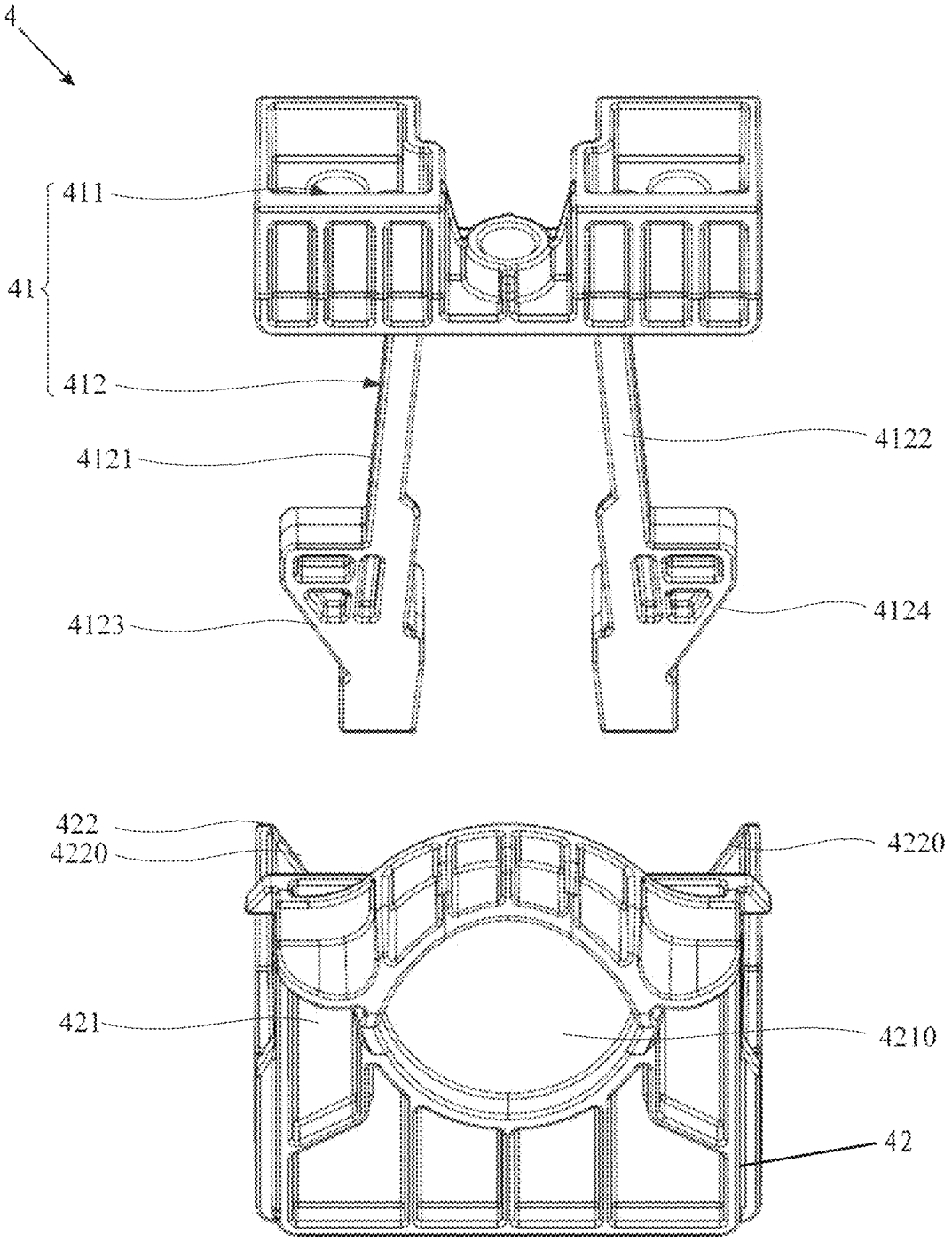
FIG. 4 is an exploded perspective view of a locking unit of the container shown in FIG. 1.
Figure 5:
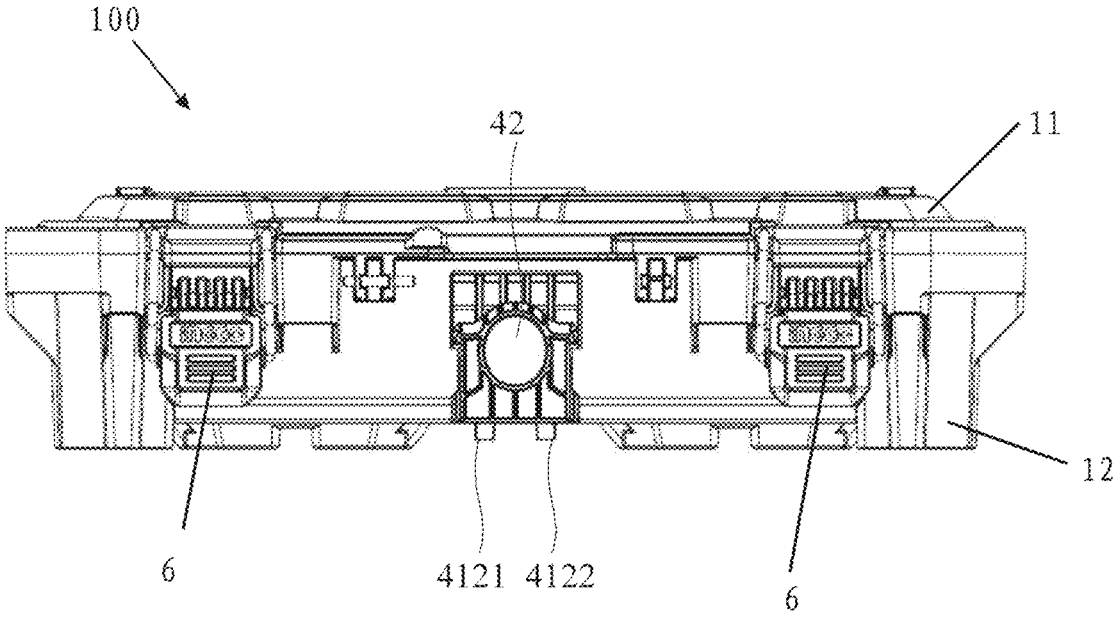
FIG. 5 is a schematic front view of the container as shown in FIG. 1, wherein a first elastic arm and a second elastic arm are in a free state.
Figure 6:
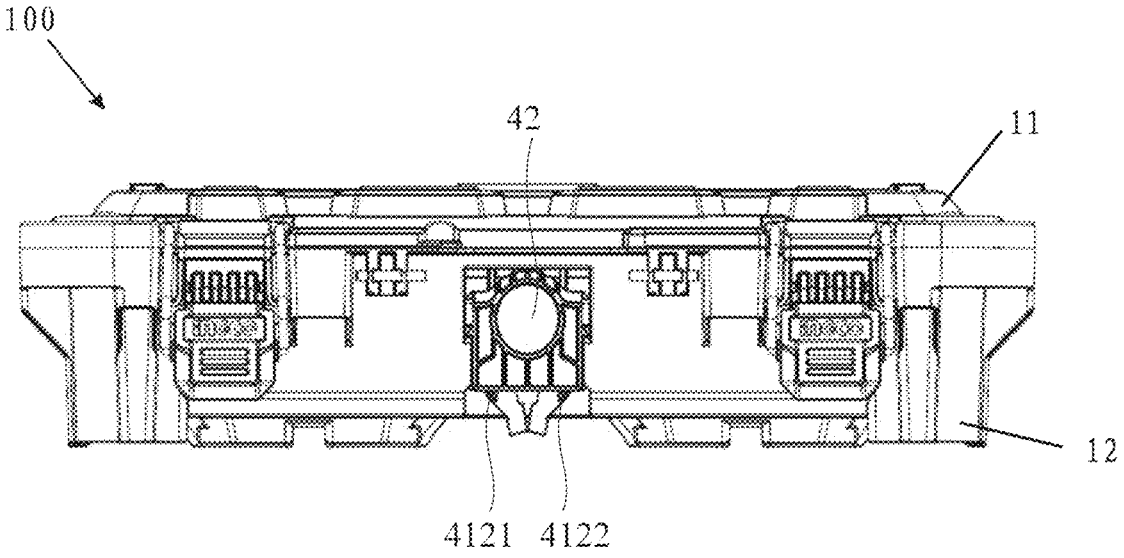
FIG. 6 is a schematic front view of the container as shown in FIG. 1, wherein the first elastic arm and the second elastic arm are in a maximum deformation state.
Figure 7:
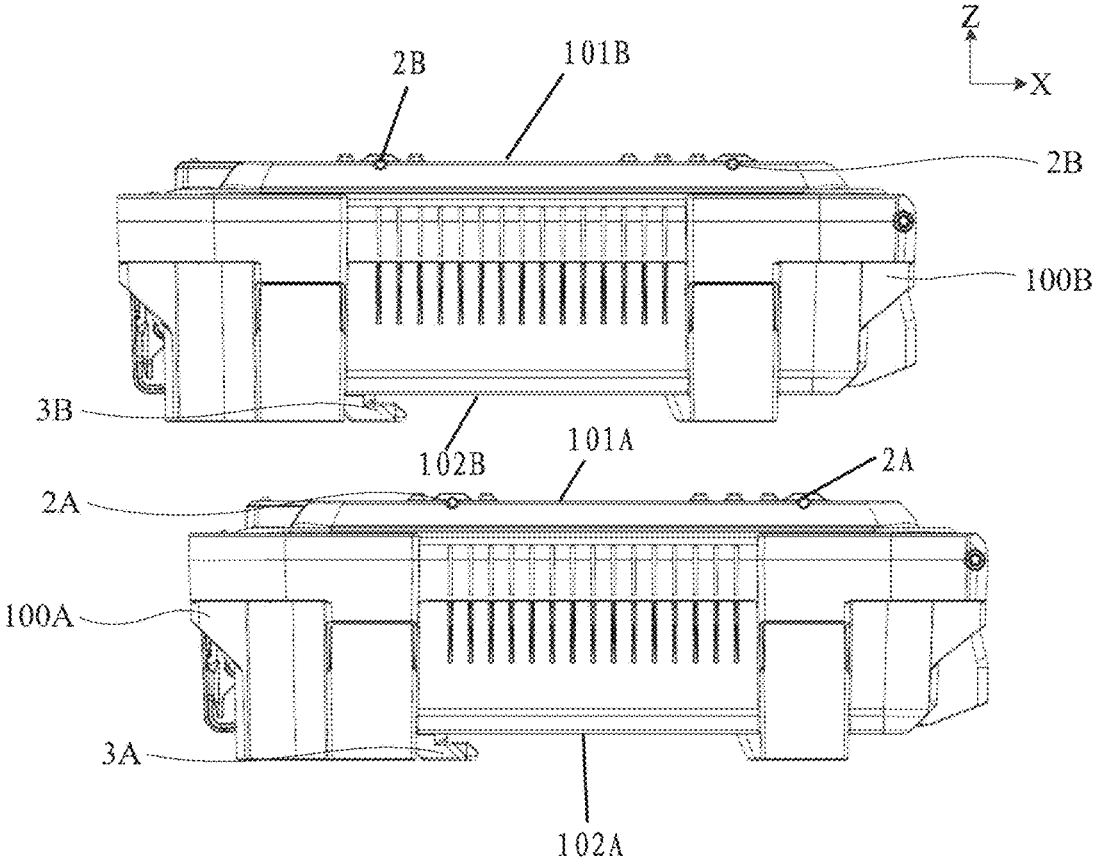
FIG. 7 is a schematic side view of a container assembly of the present application, wherein two containers are not assembled.
Figure 8:
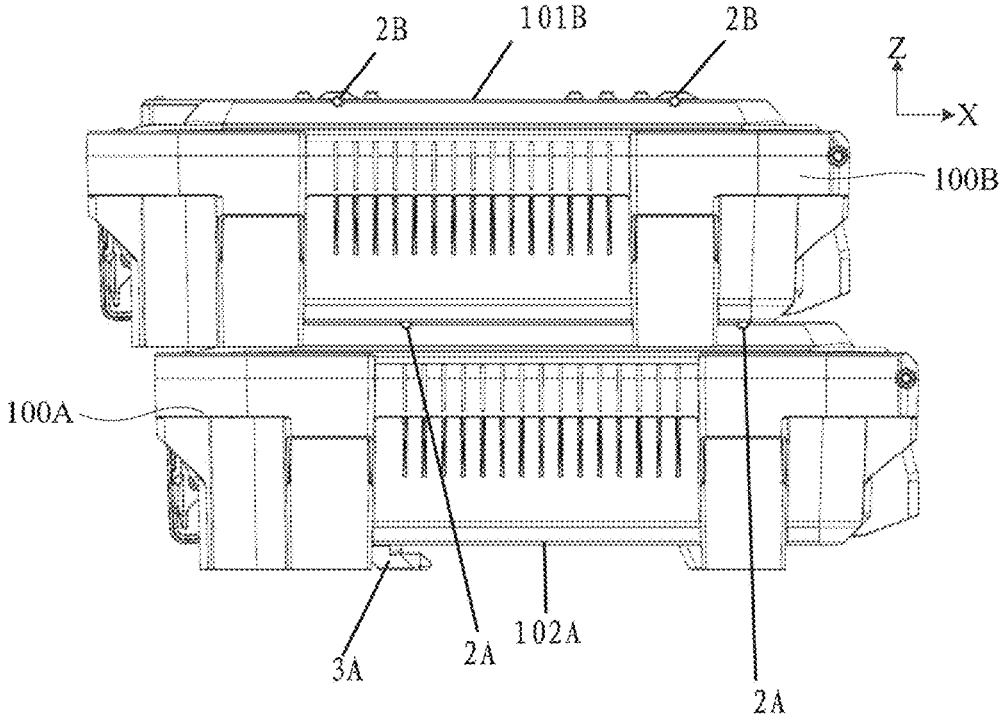
FIG. 8 is a schematic side view of the container assembly as shown in FIG. 7, wherein the two containers are being assembled to each other.
Figure 9:
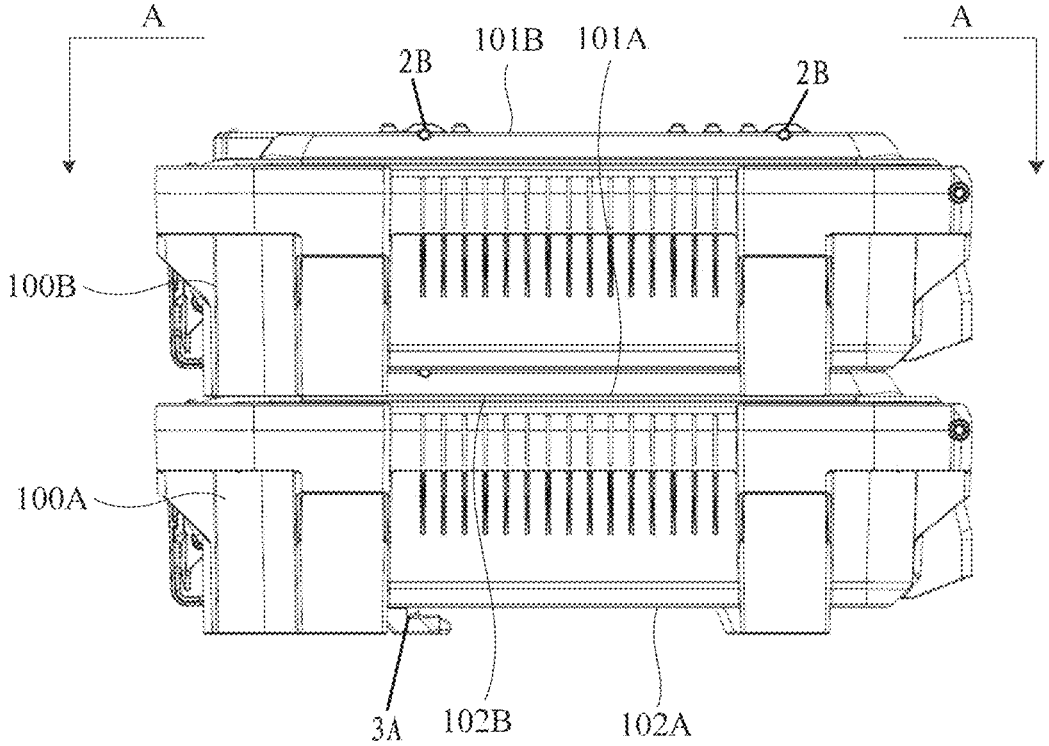
FIG. 9 is a schematic side view of the container assembly as shown in FIG. 7, wherein the two containers are assembled to each other.
Figure 10:
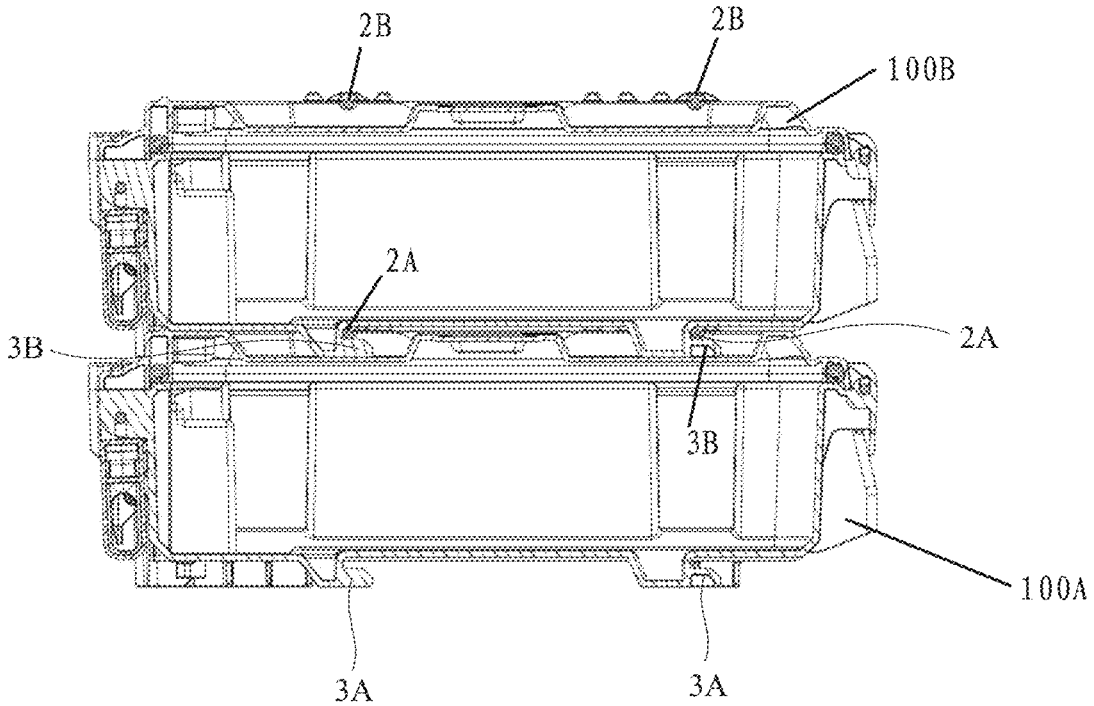
FIG. 10 is a schematic sectional view of the container assembly as shown in FIG. 9 along the line A-A.

Next, an exemplary embodiment of a locking unit 4 will be described in more detail with reference to FIGS. 4 to 6. The locking unit 4 comprises a locking component 41 and an unlocking component 42 that can drive the locking component 41 to shift its state.

The locking component 41 comprises a fixation portion 411 fixed to the base 12 and a locking portion 412 connected with the fixation portion 411, wherein the locking portion 412 comprises a first elastic arm 4121 and a second elastic arm 4122 which are separate from each other. The first elastic arm 4121 has a first engagement surface 4123, and the second elastic arm 4122 has a second engagement surface 4124.

The unlocking component 42 is configured to drive the first elastic arm 4121 and the second elastic arm 4122, so that they can be elastically deformed and thus can be close to each other, and therefore the locking component 41 (or the first elastic arm and the second elastic arm) is shifted from a locked state to an unlocked state.

Specifically, the unlocking component 42 is slidably mounted to the base 12, and comprises an operation portion 421 with a concave operation area 4210 and a driving portion 422 with a driving surface 4220. When the unlocking component 42 isn't engaged with the locking component 41, the first elastic arm 4121 and the second elastic arm 4122 can be in a free state, wherein the first engagement surface 4123 and the second engagement surface 4124 may respectively have an oblique angle to the driving surface 4220. When the unlocking component 42 moves toward the locking component 41, the driving portion 422 can drive the first elastic arm 4121 and the second elastic arm 4122 to move toward each other and thus close to each other. When the first elastic arm 4121 and the second elastic arm 4122 reach their maximum deformation position (see FIG. 6), the end of the locking component 41 has a size d1 in the second direction. When the first elastic arm 4121 and the second elastic arm 4122 are in their free state (see FIG. 5), the end of the locking component 41 has a size d2 in the second direction, wherein d1 is less than d2. The elastic forces of the first elastic arm 4121 and the second elastic arm 4122 can be used for the self-restoring of the elastic arms. Both the locking component 41 and the unlocking component 42 may be made of a plastic material, and a metal spring isn't necessary, and thus the locking unit 4 would not fail due to the oxidation of the metal spring.

The container 100 further comprises a locking groove 113 and a guide groove 114 (see FIG. 3) formed in the upper cover 11. The locking groove 113 and the guide groove 114 are communicated through an opening 1130, wherein a size of the opening 1130 in the second direction Y is greater than or equal to d1 and less than d2. The guide groove 114 is substantially trapezoidal, and the locking groove 113 is substantially rectangular. When one container is assembled with another container, the locking component 41 of the one container first enters the guide groove 114 of the other container and is elastically deformed, and then enters the locking groove 113 through the opening 1130, wherein the first elastic arm 4121 and the second elastic arm 4122 are restored to their original state and thus are restrained by a locking surface 1131 of the locking groove 113, which faces away from the guide groove 114 and extends parallel to the second direction Y. The locking surface 1131 extends from the opening 1130 to two opposite sides and extends perpendicular to the opening 1130.

In FIG. 1 and FIG. 3, three same locking grooves 113 and three same guiding grooves 114 can be seen, in which the locking grooves and the guiding grooves at two sides are associated with two corresponding buckle units 6, and the central locking groove and the central guiding groover are associated with one corresponding locking unit 4.

Optionally, the unlocking component 42 is mounted to the base 12 in a slidable manner in the third direction Z. The engagement surface 412 is inclined relative to the third direction Z. When two assembled containers are disassembled from each other, a user needs to lift the upper container slightly upward (in the third direction Z) at first, wherein the user can operate the unlocking component 42 with one finger and meanwhile lift the upper container with other fingers, that is to say, one coherent action of one hand is sufficient for disassembling the two containers, and thus operation steps of the user are simplified. On the other hand, when two containers are assembled to each other, the first elastic arm 4121 and the second elastic arm 4122 are guided and deformed by the guide groove 114, and thus the user needs not drive the elastic arms separately.

Figure 11:
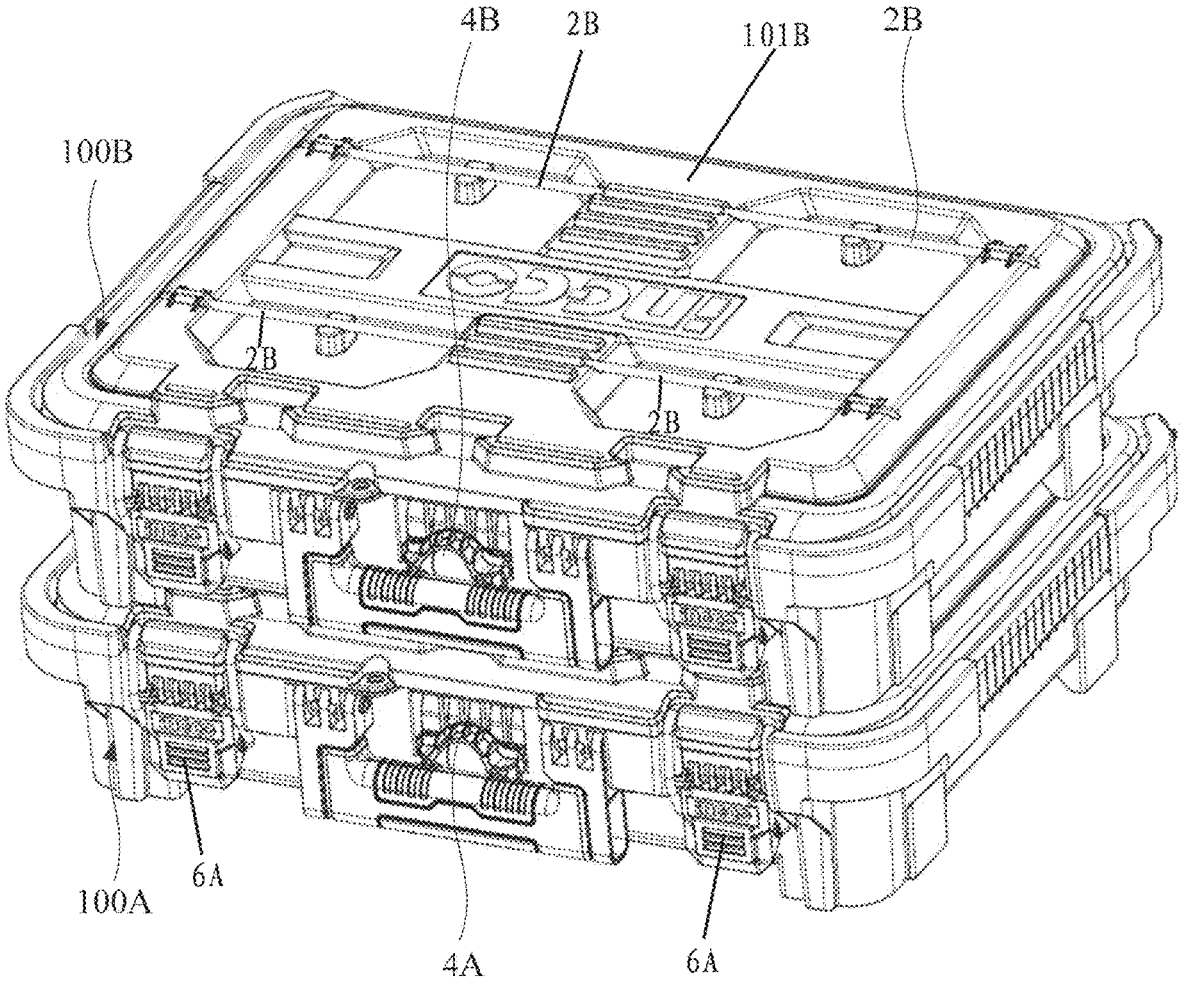
FIG. 11 is a perspective view of the container assembly as shown in FIG. 9.

With reference to FIGS. 7 to 11, an exemplary container assembly is described below, which comprises a first container 100A and a second container 100B. The first container 100A and the second container 100B may be configured substantially same to the above-mentioned container 100, wherein the reference numerals for the same parts are appended with a letter A or B to distinguish the two containers from each other. The first container 100A and the second container 100B are assembled to each other in the first direction X, and the first surface 101A of the first container 100A is associated with the second surface 102B of the second container 100B, wherein the latch element 3B of the second container 100B is associated with (the arm of) the connection element 2A of the first container 100A for the positioning of the two containers in the height direction (i.e. the third direction Z). Referring to FIG. 11, the locking unit 4B of the second container 100B is associated with the locking groove of the first container 100A for the positioning of the two containers in the first direction X and in the second direction Y.

An assembling process of the two containers 100A and 100B is described with reference to FIGS. 7 to 11. In turn, other containers can be assembled under the first container 100A and above the second container 100B.

Figure 12:
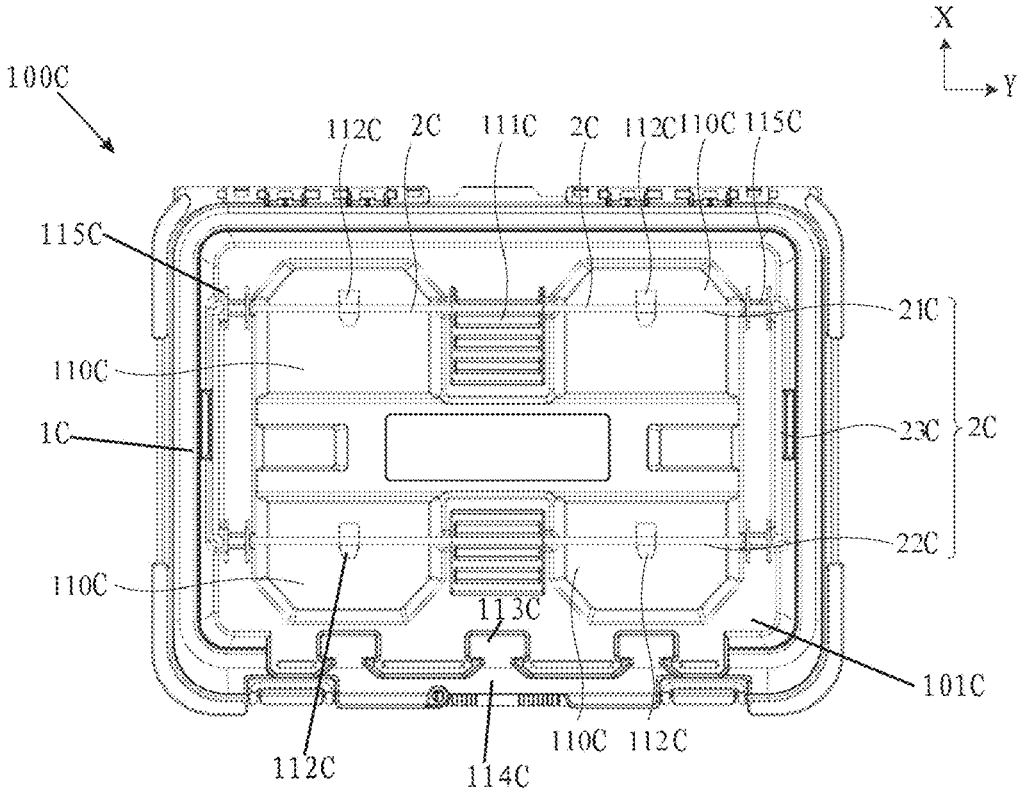
FIGS. 12 and 13 are plan views of a container in another embodiment of the present application.

Now, a container in another embodiment of the present application will be described with reference to FIGS. 12 and 13, in which reference numerals for the parts with the same function or for the same parts are appended with the letter C. The difference between this embodiment and the above-mentioned embodiments may mainly lie in the structure of the connection element 2C and the associated structure related to the connection element 2C, and other aspects may be same or similar to those in the above-mentioned embodiments. For the sake of brevity, the differences between the container 100C in this embodiment and the container 100 in the previous embodiments will be mainly described below, and for other aspects, references can be made to the above description, and they are not repeatedly described. As an example, the first surface 101C may be compared with the first surface 101 of the container 100, and these two first surfaces may be constructed identically, similarly or differently. The container 100C has two connection elements 2C mounted to the container body 1C and arranged on the first surface 101C of the container body. Each connection element 2C comprises a first arm 21C and a second arm 22C which are suspended on the first surface 101C, wherein the first arm 21C and the second arm 22C can be associated with two respective latch elements of the other container, so that the two containers can be assembled to each other.

Figure 13:
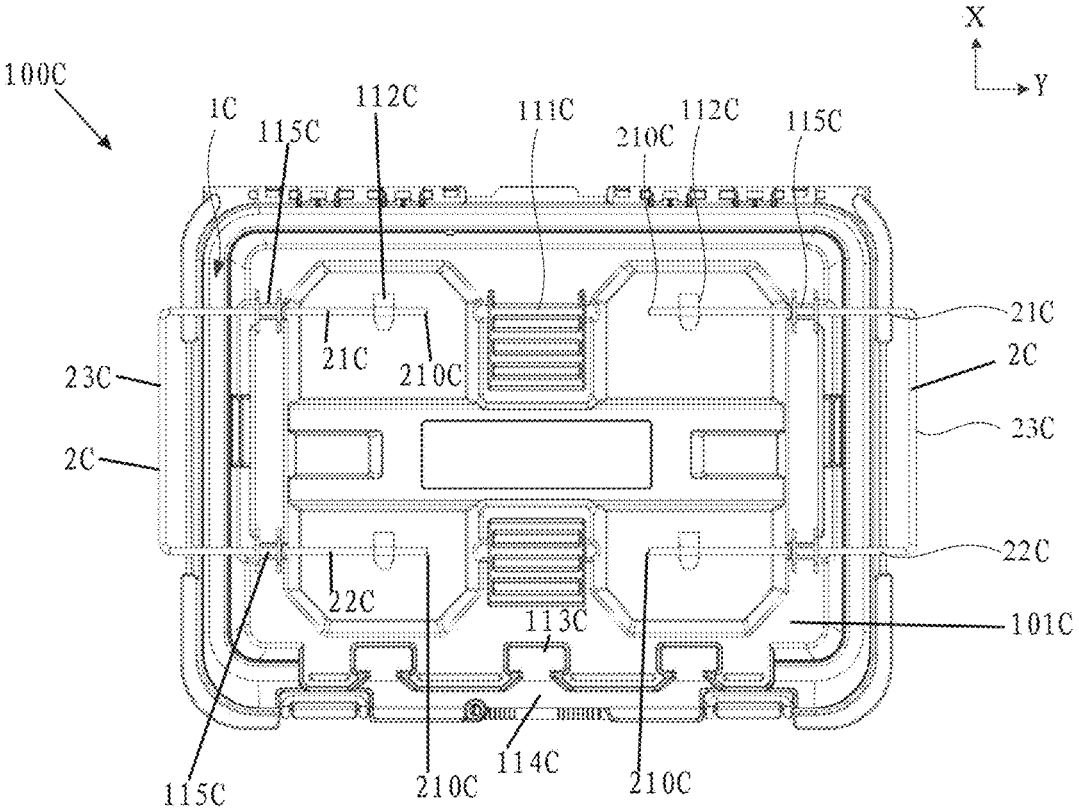

Each connection element 2C has a first position (see FIG. 12) and a second position (see FIG. 13). When the connection element 2C is in the first position, an orthographic projection of the bridge 23C on the first surface 101C is located within the container body 1C, and thus the bridge 23C doesn't occupy a room outside the container body 1C. When the connection element 2C is in the second position, an orthographic projection of the bridge 23C on the first surface 101C at least partially protrudes from the container body 1C, that is to say, when the connection elements 2C are in the second position, the bridges 23C protrude outside the container body 1C, thereby the user can grip the connection elements 2C or the bridges 23C, and hence the user can easily lift the container 100C. In this embodiment, the number of connection elements 2C is two, and the two bridges 23C are configured to be gripped by the user, so that the whole container 100C can be lifted in a horizontal state, especially when the orientation of the articles within the container 100C should not be changed.

A plurality of containers 100C can be assembled to each other in the first direction X to form a container assembly. The container body 1C comprises four spaces 110C in the first surface 101C, which are arranged in a 2×2 matrix. As seen in the drawing plane of FIGS. 12 and 13, the first arm 21C of the right first connection element 2C is located in the upper right space 110C, and the second arm 22C of the right first connection element 2C is located in the lower right space 110C; the first arm 21C of the left second connection element 2C is located in the upper left space 110C, and the second arm 22C of the left second connection element 2C is located in the lower left space 110C. A plurality of protrusions 112C are arranged in the respective spaces 110C for supporting the first arm and the second arm of the first connection element and the first arm and the second arm of the second connection element. Each protrusion 112C is provided with a groove running therethrough in the second direction, and the first arm or the second arm of the respective connection element passes through the groove.

Each connection element 2C further comprises a bridge 23C connecting the first arm 21C and the second arm 22C, so that the connection element 2C is generally U-shaped. In this embodiment, the bridge 23C extends in a straight line and is perpendicular to the first arm 21C and the second arm 22C. In other embodiments, the bridge 23C may also extend in a curve, such as in a circular arc or in a zigzag course.

The main difference between this embodiment and the previous embodiments lies in that a bridge 23C is provided, wherein the first arm 21C is equivalent to the arm 21 of a connection element 2 in FIG. 1, and the second arm 22C is equivalent to the arm 21 of another connection element 2. Other aspects in this embodiment may be substantially same to those in the embodiment shown in FIG. 1, and furthermore, the assembling process of multiple containers may also be substantially same to that in the embodiment shown in FIG. 1, and thus repeated description is spared. In this embodiment, the number of connection elements 2C of each container body 1C is two, i.e. a first and a second connection element are provided. An opening of the first connection element faces an opening of the second connection element. As shown in FIG. 12, the first connection element is partially received in the ribs and are supported by the ribs 111C. The second connection element is also partially received in the ribs and are supported by the ribs 111C. The ribs are respectively located between two adjacent spaces 110 C in the second direction Y. The protrusions 112C in the two upper spaces 110C support the first arms 21C of the two connection elements 2C, and the protrusions 112C in the two lower spaces 110C support the second arms 22C of the two connection elements. Each protrusion is provided with a groove running therethrough in the second direction Y, wherein the first arm 21C or the second arm 22C of the respective connection element 2*c* passes through the groove.

On the first surface 101C, the container body 1*c* is provided with stops 115C for the arms of the connection elements 2C. The positions of the stops on the first surface may be selected such that, in the first position of the connection elements 2C, each stop is located at a transition region from the respective arm 21C, 22C to the bridge 23C.

Each protrusion 112C has a lateral surface facing the respective stop 115C. When the connection element 2C is located in the second position, the lateral surface is located between a free end 210C of the respective arm 21C, 22C and the bridge 23C of the connection element 2C, that is to say, in the second position, the protrusions 112C and the stops 115C can still support the connection elements 2*c* to ensure the reliability of transportation.

Two or more such containers can be assembled to each other by means of association of the connection elements of one container with the latch elements of another container, thus facilitating the storage or transportation of the containers or the container assembly. In the shown embodiment, the connection elements may be separately molded, and the mold cost is low, and furthermore, the connection elements may also have a high structural strength.

The above description is directed to some preferable embodiments in the application, which should not limit the application in any form. Though the application has been disclosed by means of the preferable embodiments, they aren't intended to limit the application. A skilled person in the art can make changes or modify the embodiments under the teaching of the disclosed embodiments without departing from the protection scope of the application. Modifications and equivalents should fall into the protection scope of the application.

What is claimed is:

1. A container comprising:

a container body having a first surface and a second surface opposite to each other, wherein the first surface comprises a space recessed from the first surface;

a connection element mounted to the container body; and a latch element connected to the container body, wherein:

the connection element has an arm suspended on the first surface in a region of the recessed space, and the latch element is arranged on the second surface;

the container is configured such that, when two containers are assembled to each other, the first surface of one container of the two containers can be associated with the second surface of the other container of the two containers, wherein the latch element of the other container can be associated with the arm of the one container;

the container is configured such that, when two containers are assembled to each other, the other container can be assembled to the one container in a first direction; and the container body comprises a plurality of spaces aligned in a second direction perpendicular to the first direction and ribs between respective two adjacent spaces, the connection elements are partially received in the ribs and are supported by the ribs, and the arms are located in the spaces.

2. The container as recited in claim 1, wherein the connection element of the container has a first arm and a second arm which are suspended on the first surface, and a first latch element and a second latch element are arranged on the second surface, wherein the first arm and the second arm and the first latch element and the second latch element are configured such that, when two containers are assembled to each other, the first latch element of the other container can be associated with the first arm of the one container, and the second latch element of the other container can be associated with the second arm of the one container; and wherein the connection element further comprises a bridge connecting the first arm and the second arm, wherein the connection element has a first position, in which an orthographic projection of the bridge on the first surface is located within the container body, and a second position, in which an orthographic projection of the bridge on the first surface at least partially protrudes from the container body, so that the bridge can be gripped by a user.

3. The container as recited in claim 2, wherein the container is configured such that, when two containers are assembled to each other, the other container can be assembled to the one container in a first direction; and wherein the container body has a first and a second space aligned in the first direction, the first arm of the connection element is located in the first space, and the second arm of the connection element is located in the second space.

4. The container as recited in claim 2, wherein the container is configured such that, when two containers are assembled to each other, the other container can be assembled to the one container in a first direction; and wherein the connection element is movable in a second direction perpendicular to the first direction when it's shifted from the first position to the second position, and a range of movement is less than half of a length of the first arm.

5. The container as recited in claim 1, wherein the connection element is rotatably mounted to the container body.

6. The container as recited in claim 1, wherein the container has a plurality of spaces disposed on the first surface and aligned in the first direction, wherein the number of the connection elements is plural and the plurality of connection elements are aligned in the first direction, wherein the number of the latch elements on the second surface of the container is plural and the plurality of latch elements are aligned in the first direction, wherein the plurality of connection elements and the plurality of latch elements are configured such that, when two such containers are assembled to each other, the plurality of latch elements of the other container are associated with the respective connection elements of the one container.

7. The container as recited in claim 6, wherein each space comprises a bottom surface and a first side surface, a second side surface, a third side surface and a fourth side surface connected to the bottom surface, wherein the first side surface, the second side surface, the third side surface and the fourth side surface respectively have an obtuse angle to the bottom surface, wherein the first side surface and the second side surface extend parallel to the first direction, and the third side surface and the fourth side surface extend parallel to an extension direction of the respective connection element.

8. The container as recited in claim 7, wherein the third side surface and the fourth side surface are aligned in the first direction, wherein a distance from the arm to the third side surface is greater than a distance from the arm to the fourth side surface, wherein the third side surface is upstream of the fourth side surface in an assembling direction of the container.

9. The container as recited in claim 1, wherein the container body comprises a protrusion which is located in the respective space and supports the arm of the respective connection element, wherein the protrusion has a groove running therethrough in the second direction, and the respective connection element is partially received in the groove.

10. The container as recited in claim 1, wherein the container comprises a locking unit and a locking groove running through the first surface, wherein the locking unit and the locking groove are configured such that, when two containers are assembled to each other, the locking unit of the other container is associated with the locking groove of the one container for the positioning of two containers in the first direction and in a second direction perpendicular to the first direction, and wherein the arm of the connection element of the one container is associated with the latch element of the other container for the positioning of two containers in a third direction perpendicular to the first and the second direction.

11. The container as recited in claim 1, wherein the first surface is a top surface of the container body, and the second surface is a bottom surface of the container body.

12. A container assembly comprising a first container and a second container that are detachably assembled to each other, wherein the first container has a first surface comprising a space recessed from the first surface, and the second container has a second surface, wherein the first surface and the second surface are associated when the first container and the second container are assembled to each other, wherein:

the first container comprises a first container body and a connection element mounted to the first container body, wherein the connection element has an arm suspended on the first surface in a region of the recessed space, and wherein the second container comprises a latch element arranged on the second surface, wherein the latch element is configured to be associated with the arm for assembling the first container and the second container;

the first container and the second container are configured such that, when the first container and the second container are assembled to each other, the second container can be assembled to the first container in a first direction; and the first container body comprises a plurality of spaces aligned in a second direction perpendicular to the first direction and ribs between respective two adjacent spaces, the connection elements are partially received in the ribs and are supported by the ribs, and the arms are located in the spaces.

13. The container assembly as recited in claim 12, wherein at least one of the first container or the second container comprises:

a container body having a first surface and a second surface opposite to each other;

a connection element mounted to the container body; and a latch element connected to the container body, wherein:

the connection element has an arm suspended on the first surface and the latch element is arranged on the second surface; and the container is configured such that, when two containers are assembled to each other, the first surface of one container of the two containers can be associated with the second surface of the other container of the two containers, wherein the latch element of the other container can be associated with the arm of the one container.

14. A container assembly comprising a first container and a second container that are detachably assembled to each other, wherein:

the first container comprises a container body and a connection element mounted to the container body, wherein ends of the connection element are supported by the container body and the connection element has an arm arranged in a suspended manner on a first surface of the first container in a region of space recessed from the first surface, and wherein the second container comprises a latch element configured to be associated with the arm for assembling the first and the second container;

the first container and the second container are configured such that, when the first container and the second container are assembled to each other, the second container can be assembled to the first container in a first direction; and the first container body comprises a plurality of spaces aligned in a second direction perpendicular to the first direction and ribs between respective two adjacent spaces, the connection elements are partially received in the ribs and are supported by the ribs, and the arms are located in the spaces.

15. The container assembly as recited in claim 14, wherein the connection element comprises a first arm and a second arm that are arranged in a suspended manner, and wherein the second container comprises a first latch element and a second latch element, wherein the first latch element is configured to be associated with the first arm and the second latch element is configured to be associated with the second arm for assembling the first container and the second container, wherein the connection element further comprises a bridge connecting the first arm and the second arm, and the bridge is configured to be gripped by a user.

16. The container assembly as recited in claim 15, wherein the first container has a first surface associated with the second container, wherein the connection element has a first position, in which an orthographic projection of the bridge on the first surface is located within the container body, and a second position, in which an orthographic projection of the bridge on the first surface at least partially protrudes from the container body.

17. The container assembly as recited in claim 16, wherein the container body has a first space and a second space aligned in a first direction, the first arm of the connection element is located in the first space, and the second arm of the connection element is located in the second space, wherein the first container is assembled to the second container in the first direction.

18. The container assembly as recited in claim 14, wherein at least one of the first container or the second container comprises:

a container body having a first surface and a second surface opposite to each other;

a connection element mounted to the container body; and a latch element connected to the container body, wherein:

the connection element has an arm suspended on the first surface and the latch element is arranged on the second surface; and the container is configured such that, when two containers are assembled to each other, the first surface of one container of the two containers can be associated with the second surface of the other container of the two containers, wherein the latch element of the other container can be associated with the arm of the one container.

* * * * *